United States Patent [19]

Russo

[11] 4,150,793

[45] Apr. 24, 1979

[54] GUTTER CLEANING APPARATUS

[76] Inventor: Alberto Russo, 413 Waverly Ave., Mamaroneck, N.Y. 10543

[21] Appl. No.: 874,805

[22] Filed: Feb. 3, 1978

[51] Int. Cl.[2] ..... B05B 1/14; B05B 12/04

[52] U.S. Cl. ..... 239/532; 239/66; 239/562; 239/565; 239/570; 137/119

[58] Field of Search ..... 239/66, 99, 532, 562, 239/563, 565, 570, 571; 137/119

[56] References Cited

U.S. PATENT DOCUMENTS

| | | | |
|---|---|---|---|
| 2,893,416 | 7/1959 | Hegstad | 137/119 |
| 2,910,711 | 11/1959 | Mizelle | 239/532 UX |
| 3,116,750 | 1/1964 | Tidd | 137/119 |
| 3,845,777 | 11/1974 | Gilson | 239/66 X |
| 3,908,910 | 9/1975 | Detwiler | 239/587 X |

FOREIGN PATENT DOCUMENTS

| | | | |
|---|---|---|---|
| 1235456 | 6/1971 | United Kingdom | 137/119 |

*Primary Examiner*—Robert W. Saifer
*Attorney, Agent, or Firm*—Robert J. Eichelburg

[57] ABSTRACT

Gutter cleaning apparatus is disclosed comprising a housing having a first and second opening therein for delivering fluid under pressure into a rain gutter mounted on a building. The openings are diametrically opposed and the flow of fluid through the openings is controlled by a valve that alternately opens one opening and closes the other. The valve is controlled by increasing and decreasing the fluid pressure in the housing. When fluid pressure is at a pre-determined lower level, the valve is in a neutral position between the two openings. A stream deflector plate extends from the bottom of the valve and depending on which direction the deflector plate is positioned, increasing the pressure in the housing will cause the valve to move into one of the openings. Once the valve is positioned in one of the openings the direction of the stream deflector plate is changed since it is mounted on the valve in a manner so as to engage the housing when the valve is closing one of the openings. When the pressure within the housing is reduced, the valve plate returns to a neutral position and with the stream deflector plate positioned at a different angle, the valve will close the opposite opening when fluid pressure in the housing is again increased.

6 Claims, 6 Drawing Figures

GUTTER CLEANING APPARATUS

SUMMARY OF THE INVENTION

The present invention relates to apparatus comprising a hollow housing having an influent port and an effuent port. A flow path is defined in the housing between the influent port and the effluent port. The effluent port has a first opening and a second opening therein. A valve is mounted in the housing, the valve extending along a longitudinal axis displacable to project into the flow path. The valve is arranged to swing in the housing for alternately closing the first opening and the second opening. The valve terminates in a stream deflector member, the stream deflector member being operatively connected to the valve by a stream deflector hinge. The stream deflector extends along a longitudinal axis, the axis of the stream deflector being displacable to project into the flow path at a first angle with respect to the axis of the valve when the valve is positioned to close the first opening or the second opening. The stream deflector hinge holds the valve and the stream deflector so that the axes of each is at the first angle when the valve is displaced into the flow path and the axis of the value projects into the flow path. The axis of the stream deflector is displacable to project into the flow path at a second angle with respect to the axis of the valve when the valve is positioned to close the other of the first openings or second openings. The stream deflector hinge holds the valve and the stream deflector so that the axes of each is at the second angle when the valve is redisplaced into the flow path and the axis of the valve projects into the flow path. When fluid under pressure is passed through the flow path, fluid will impinge on the stream deflector to force the valve into one of the openings and allow fluid to flow through the other of the openings. The axis of the stream deflector will be displaced at first angle into the flow path, and when fluid pressure is reduced, the axis of the valve will be aligned substantially parallel to the direction of fluid flow in the flow path. The stream deflector will then remain at the first angle to the valve so that by increasing fluid pressure, the valve will be deflected by the stream deflector to close the other of the openings and the first angle between the stream deflector and the valve will be changed to the second angle.

The stream deflector may comprise a stream deflector plate having a first and second face opposed to one another, the axis of the stream deflector and the valve being at an angle to align the first face into the flow path when one of the openings is closed and then to align the second face into the flow path when the other of the openings is closed.

The first and second openings may be insertable in a rain gutter, the first and second openings being diametrically opposed to one another to clean the gutter.

The housing member may be mounted on a rigid tube to extend upwardly to a rain gutter mounted on a building.

Apparatus is also provided for delivering fluid to an aperture comprising a resilient member having an influent port and an effluent port. A tube is removably insertable into the influent port to form a substantially fluid tight seal between the tube and the resilient member and for delivering fluid under pressure into the resilient member.

The hollow resilient member may comprise a hollow cone member.

A rigid pipe may be secured to the tube affixed to the hollow resilient member or the hollow resilient cone member to extend upwardly to a rain gutter downspout mounted on a building so that fluid under pressure may be delivered to the downspout to clean the downspout.

DETAILED DESCRIPTION

Cleaning tools for gutters and eavetroughs are disclosed in the prior art U.S. Pats. to Detwiler, No. 3,908,910; Milhous, No. 3,023,971 and Mizelle, No. 2,910,711.

The afore-mentioned prior art references illustrate the state of the art relative to positioning water hoses in rain gutters by means of a rigid tube that can be manipulated from ground level. The difficulty with employing the Detwiler and Milhous devices is that water under pressure cannot be directed down the length of the rain gutter since the nozzle of these devices is arranged to deliver water under pressure at right angles to the longitudinal axis of the gutter. It is advantageous to clean gutters by directing a stream of water under pressure in the same direction as the longitudinal axis of the gutter so that accumulated debris may be forced to one end of the gutter and then forced up and over the end piece of the gutter.

The Mitzelle reference discloses a gutter cleaner having a nozzle to direct water under pressure in the same direction as the longitudinal axis of the gutter; however, this device does not provide for delivering water in either direction of the nozzle and limits the direction in which debris can be moved. In order to reverse the direction of the nozzle of the Mizelle reference, the device has to be removed from the gutter, the effluent port of the nozzle changed in the opposite direction and the device reinserted.

The U.S. Pat. to Schuster, No. 3,770,204 discloses a rubber cup used to contain and assist in cleaning and removal of contaminants from various areas in which cleaning is accomplished by a jet of liquid but is not readily adaptable to cleaning gutter downspouts.

It is an object of the present invention to overcome these and other difficulties encountered in the prior art.

It is a further object of the present invention to provide apparatus for cleaning gutters and downspouts on a building, the apparatus being controllable from gound level.

It is also an object of the present invention to provide novel valve apparatus to remotely control the flow of fluid from one of two openings in a housing in which the valve is mounted, control of the fluid from one of the openings being obtained by increasing and decreasing the fluid pressure in the housing.

These and other objects have been achieved according to the present invention and will become apparent by reference to the disclosure and claims that follow as well as the appended drawing.

Figure 1:
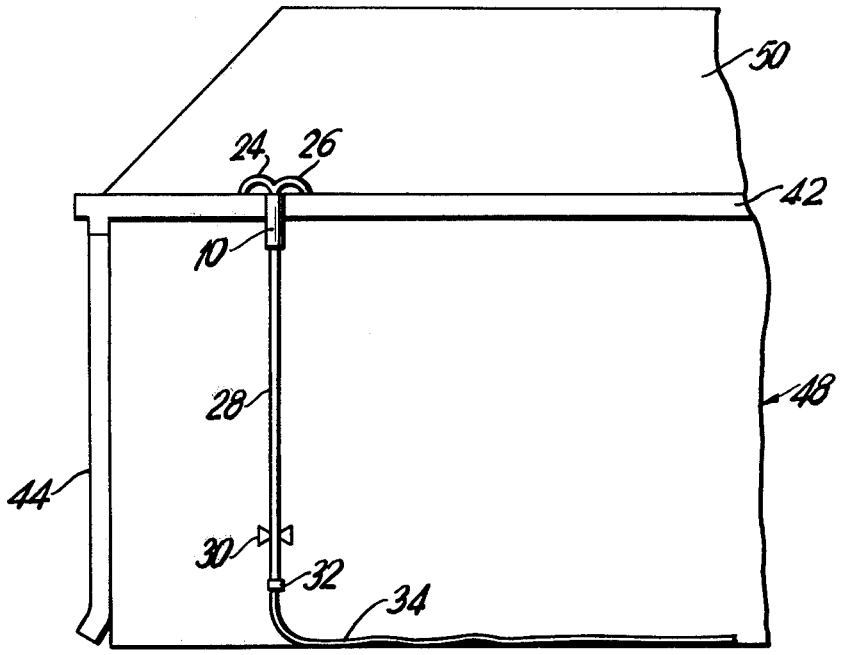
FIG. 1 comprises a side elevation illustrating the use of the novel valve apparatus for cleaning a rain gutter mounted on a building.
Figure 2:
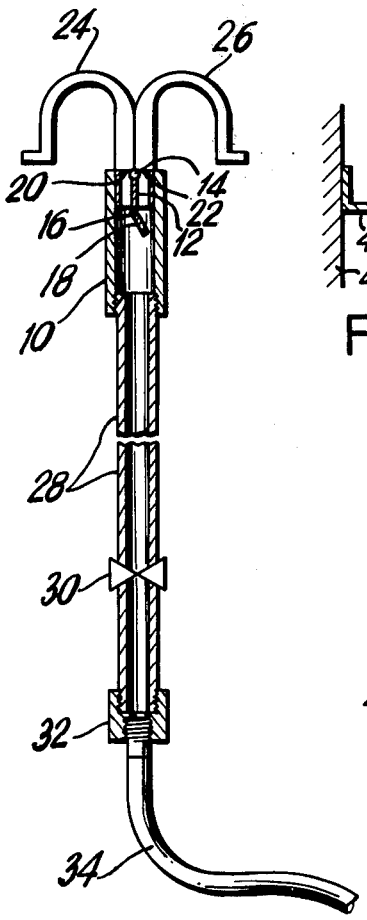
FIG. 2 comprises a side elevation in section of the novel valve apparatus of the present invention.
Figure 6:
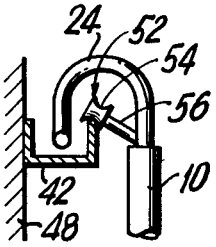
FIG. 6 comprises a side elevation of a gutter cleaner.
Figure 3:
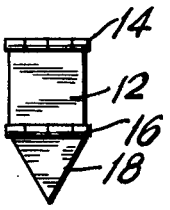
FIG. 3 comprises a front elevation of the valve plate and stream deflector plate employed as part of the valve apparatus illustrated in FIG. 2.

Referring to the drawing and FIGS. 1–5 therein, a valve housing 10 is illustrated having a valve plate 12 mounted therein by means of a hinge 14. Valve plate 12 is arranged to swing freely within the housing to close openings 20 or 22 in the vertical position shown in FIG. 2. Hinge 14 allows the valve 12 to be positioned in the flow path defined between the influent or lower portion of the housing 10 and the effluent or upper portion of the valve housing 10, the effluent end having openings 20 and 22 therein. The valve 12 as illustrated in FIG. 2 is free to swing by means of gravity and the relatively frictionless hinge 14 into a position where it is aligned vertically between the openings 20 and 22 although hinge 14 may comprise a spring hinge to resiliently bias the valve 12 into a position intermediate the openings 20 and 22. Additionally, if a spring hinge 14 is not employed, additional resilient means known in the art such as a reed spring or coil springs may be used to position valve 12 intermediate the openings 20 and 22 when there is fluid under reduced pressure in the housing 10.

Tubes 24 and 26 extend upwardly and laterally from the openings 20 and 22 respectively to divert a stream of fluid into a gutter, the openings at the ends of tubes 24 and 26 comprising extensions of the openings 20 and 22 and in the embodiment illustrated in FIG. 2 the openings at the ends of tubes 26 and 24 are diametrically opposed to one another. Alternately, the openings 20 and 22 instead of being positioned to open upwardly, may be placed in the side walls of the housing 10 and thereby eliminate the tubes 26 and 24. In this latter respect, the uppermost portion of the housing 10 would be closed by a cap or plate and the valve plate 12 arranged to swing into either of the effluent openings positioned in the side walls of housing 10. All of the foregoing rearrangement of the openings 20 and 22 is readily apparent to the skilled artisan.

A friction hinge 16 connects a stream deflector plate 18 to the valve 12, the hinge 16 being capable of holding the stream deflector plate at an angle to the valve 12 when the fluid pressure in housing 10 is reduced from one preset value to another. The hinge 16 allows the plate 18 to swing through an arc so that the longitudinal axis of the plate 18 and the longitudinal axis of the valve 12 can be arranged at a first angle to the flow path in housing 10 when the valve 12 seals off opening 20 and at a second angle to the flow path in housing 10 when the valve 12 is employed to seal off the opening 22. Again, the friction hinge 16 will hold the plate 18 at the first angle or the second angle when fluid pressure in the housing 10 is reduced.

Housing 10 is secured to a rigid pipe 28 having a valve 30 therein, a pipe 28 being connected to a flexible hose 34 through a coupling 32. A bobbin 52 having identation 54 thereon is rotatably mounted on housing 10 by means of a shaft 56, bobbin 52 acting as a rolling guide for engaging the edge of gutter 42 as the gutter cleaner is moved down the gutter 42.

The invention also relates to apparatus for cleaning rain gutter downspouts, this apparatus comprising a flexible or resilient hollow housing such as a hollow rubber cone 36 having a pipe 38 inserted in the tapered end of housing 36. A water line such as a u-shaped rigid pipe 40 is connected to the pipe 38 for delivering water under pressure into the pipe.

In use, the apparatus of FIG. 2 is inserted in a rain gutter 42 mounted on a house 48 having a roof 50. Rain gutter 42 terminates in a downspout 44. Water under pressure is delivered into pipe 28 by means of hose 34, the water in pipe 28 being controlled through valve 30.

Referring to FIG. 2, when water under pressure enters housing 10, the stream deflector plate 18 which is set at a first angle will have water impinge against it and force the valve 12 into opening 22. When valve 12 is seated in opening 22 stream deflector plate 18 will reverse direction through the friction hinge 16 and will be set at a second angle whereas water in pipe 28 will exit opening 20 and through the tube 24 into the gutter 42. In order to reverse the flow of water from the tube 24 into tube 26, water pressure is reduced or turned off by means of valve 30 whereupon the hinge 14 will return valve 12 to a substantially vertical position whereas the stream deflector plate 18 will be set at a second angle approximately equal but opposite to the angle illustrated in FIG. 2. When water pressure is increased or the water is turned on again through valve 30, water will impinge against the stream deflector plate 18 and force the valve plate 12 upwardly into opening 20 to close off this opening. Water will then exit opening 22 under pressure and from there the water under pressure will pass through tube 26 in the opposite direction in gutter 42.

Figure 4:
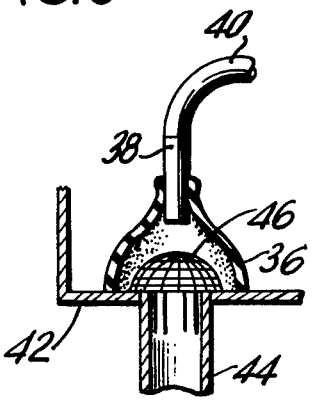
FIG. 4 comprises a side elevation in section of a resilient hollow cone employed for delivering fluid under pressure to a rain gutter downspout having a debris screen over the downspout.
Figure 5:
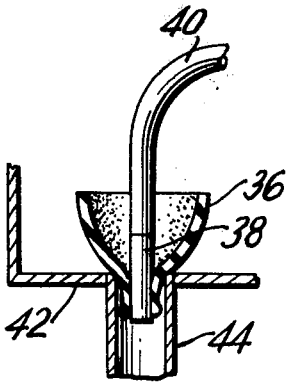
FIG. 5 comprises a side elevation in section of a resilient hollow cone inserted into a rain gutter downspout for delivering fluid under pressure into the downspout.

Referring to FIGS. 4 and 5, the resilient hollow housing 36 is positioned over a gutter downspout 44 extending from gutter 42, the housing 36 being positioned over a screen 46 and the water line 40 attached to the end of the pipe 38 that extends outwardly of the housing 36. Water under pressure can be directed into the downspout 44 over screen 46 by means of the water line 40 and pipe 38. If the screen 46 is removed, the water line 40 is connected to the reverse end of the pipe 38 and the hollow housing 36 is inserted into the gutter as illustrated in FIG. 5.

Although the invention has been described by reference to some embodiments, it is not intended that the novel gutter cleaning apparatus and the valve apparatus employed in combination therewith or the downspout cleaning apparatus be limited thereby but that modifications thereof are intended to be included as falling within the broad spirit and scope of the foregoing disclosure, the following claims and the appended drawing.

What is claimed is:

1. Valve apparatus comprising hollow housing means having influent port means and effluent port means, a flow path being defined in said housing means between said influent port means and said effluent port means, said effluent port means having first opening means and second opening means, valve means mounted in said housing means, said valve means extending along a longitudinal axis displaceable to project into said flow path, said valve means arranged to swing in said housing means for alternately closing said first opening means and said second opening means, said valve means terminating in stream deflector means, said stream deflector means operatively connected to said valve means by stream deflector hinge means, said stream deflector means extending along a longitudinal axis, said axis of said stream deflector means being displaceable to project into said flow path at a first angle with respect to the axis of said valve means when said valve means is positioned to close said first opening means or said second opening means, said stream deflector hinge means holding said valve means and said stream deflector means so that the said axis of each is at said first angle when said valve means is displaced into said flow path and said axis of said valve means projects into said flow path, said axis of said stream deflector means being displaceable to project into said flow path at a second angle with respect to the axis of said valve means when said valve means is positioned to close the other of said first opening means or said second opening means, said stream deflector hinge means holding said valve means and said stream deflector means so that the said axes of each is at said second angle when said valve means is redisplaced into said flow path and said axis of said valve means projects into said flow path whereby when fluid under pressure is passed through said flow path, fluid will impinge on said stream deflector means to force said valve means into one of said first openings or second openings and allow fluid to flow through the other of said first openings or second openings said axis of said stream deflector means being displaced at said first angle into said flow path, and when fluid pressure is reduced, the axis of said valve means will be aligned substantially parallel to the direction of fluid flow in said flow path, said stream deflector means will remain at said first angle to said valve means so that by increasing fluid pressure said valve means will be deflected by said stream delector means to close the other of said first openings or said second openings and said first angle between said stream deflector means and said valve means will be changed to said second angle.

2. The apparatus of claim 1 where said stream deflector means comprises stream deflector plate means having a first and second face opposed to one another, said axis of said stream deflector means and said valve means being at an angle to align said first face into said flow path when one of said first openings or second openings is closed and to align said second face into said flow path when the other of said first openings or second openings is closed.

3. The apparatus of claim 2 where said first opening means and said second opening means are insertable in a rain gutter, said first opening means and said second opening means being opposed to one another for alternately cleaning said gutter in the direction of each of said openings.

4. The apparatus of claim 3 where said housing means is mounted on a rigid tube to extend upwardly to a rain gutter mounted on a building.

5. The apparatus of claim 1 wherein said first opening means and said second opening means are insertable in a rain gutter said first opening means and said second opening means being opposed to one another for alternately cleaning said gutter in the direction of each of said openings.

6. The apparatus of claim 5 where said housing means is mounted on a rigid tube to extend upwardly to a rain gutter mounted on a building.

* * * * *